US012326065B2

(12) United States Patent
Clayton et al.

(10) Patent No.: US 12,326,065 B2
(45) Date of Patent: Jun. 10, 2025

(54) HYDRAULIC INDEXING SYSTEM

(71) Applicant: Schlumberger Technology Corporation, Sugar Land, TX (US)

(72) Inventors: David Clayton, Angleton, TX (US); Jerome Prost, Gif sur Yvette (FR); Brad Swenson, Friendswood, TX (US); Michael Jasper, Saint Johns, FL (US); Gabriel Isaicu, Missouri City, TX (US); Emrah Gokdag, Missouri City, TX (US); Ron Perez, Katy, TX (US); Julia Huynh, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 320 days.

(21) Appl. No.: 18/173,939

(22) Filed: Feb. 24, 2023

(65) Prior Publication Data

US 2023/0203915 A1 Jun. 29, 2023

Related U.S. Application Data

(63) Continuation of application No. 16/620,524, filed as application No. PCT/US2017/036458 on Jun. 8, 2017, now Pat. No. 11,591,884.

(51) Int. Cl.
*E21B 34/10* (2006.01)
*E21B 23/04* (2006.01)

(52) U.S. Cl.
CPC ..... *E21B 34/10* (2013.01); *E21B 23/04* (2013.01); *E21B 34/102* (2013.01)

(58) Field of Classification Search
CPC .. E21B 23/0412; E21B 23/04; E21B 23/0421; E21B 34/102
See application file for complete search history.

(56) References Cited

U.S. PATENT DOCUMENTS 4,636,934 A 1/1987 Schwendemann
4,896,722 A * 1/1990 Upchurch ..... E21B 23/042 166/250.15

(Continued)

FOREIGN PATENT DOCUMENTS

WO 2013074392 A1 5/2013

OTHER PUBLICATIONS

Office Action issued in U.S. Appl. No. 16/781,826 dated Dec. 23, 2024, 12 pages.

(Continued)

*Primary Examiner* — Cathleen R Hutchins
(74) *Attorney, Agent, or Firm* — Jeffrey D. Frantz

(57) ABSTRACT

A technique provides a desired control over incremental actuation of hydraulic devices. A hydraulically actuated tool is combined with a control module. The hydraulically actuated tool has an actuator piston positioned in a piston chamber and movable between operating positions. The control module comprises a hydraulic indexing circuit arranged to enable incremental movement of the actuator piston in a first direction and full stroke movement in a second direction based on hydraulic input delivered via control lines. The hydraulic indexing circuit comprises an indexing piston system and at least one check valve working in cooperation with the indexing piston system to enable the incremental and full stroke movements.

18 Claims, 7 Drawing Sheets

(56) References Cited

U.S. PATENT DOCUMENTS

| | | | | |
|---|---|---|---|---|
| 6,405,803 | B1 | 6/2002 | Giroux et al. | |
| 6,422,317 | B1 | 7/2002 | Williamson, Jr. | |
| 6,494,265 | B2 | 12/2002 | Wilson et al. | |
| 6,536,530 | B2 | 3/2003 | Schultz et al. | |
| 6,585,051 | B2 | 7/2003 | Purkis et al. | |
| 6,763,892 | B2 | 7/2004 | Kaszuba | |
| 6,782,952 | B2 | 8/2004 | Garay et al. | |
| 6,869,063 | B2 | 3/2005 | Gunnarsson et al. | |
| 6,951,331 | B2 | 10/2005 | Haughom et al. | |
| 7,013,980 | B2 | 3/2006 | Purkis et al. | |
| 7,055,598 | B2 | 6/2006 | Ross et al. | |
| 7,377,327 | B2 | 5/2008 | Jackson | |
| 7,510,013 | B2 * | 3/2009 | Kimpel | E21B 34/14 166/324 |
| 7,926,569 | B1 | 4/2011 | Wintill et al. | |
| 8,006,768 | B2 | 8/2011 | Powell | |
| 8,056,643 | B2 | 11/2011 | Basmajian et al. | |
| 8,157,016 | B2 | 4/2012 | James | |
| 8,186,439 | B2 | 5/2012 | Lauderdale | |
| 8,322,446 | B2 | 12/2012 | Smithson | |
| 8,397,741 | B2 | 3/2013 | Bisset | |
| 9,228,402 | B2 | 1/2016 | Strilchuk | |
| 9,376,889 | B2 | 6/2016 | Reid et al. | |
| 10,724,334 | B2 | 7/2020 | Poluchalla et al. | |
| 2002/0014338 | A1 | 2/2002 | Purkis et al. | |
| 2008/0000643 | A1 | 1/2008 | Kimpel | |
| 2009/0283276 | A1 | 11/2009 | Mandrou et al. | |
| 2010/0212521 | A1 | 8/2010 | Resch et al. | |
| 2011/0067886 | A1 | 3/2011 | Moen | |
| 2011/0100645 | A1 | 5/2011 | Yapici | |
| 2012/0067593 | A1 | 3/2012 | Powell et al. | |
| 2014/0014373 | A1 | 1/2014 | Richards | |
| 2015/0107848 | A1 | 4/2015 | Leitch | |
| 2016/0312579 | A1 | 10/2016 | Green et al. | |
| 2016/0319635 | A1 | 11/2016 | Du et al. | |
| 2017/0022790 | A1 | 1/2017 | Leitch | |
| 2018/0274328 | A1 * | 9/2018 | Poluchalla | E21B 23/04 |
| 2020/0248533 | A1 | 8/2020 | Clayton et al. | |
| 2020/0277839 | A1 | 9/2020 | Clayton et al. | |

OTHER PUBLICATIONS

International Search Report and Written Opinion issued in PCT Application PCT/US2017/036458 dated Feb. 28, 2018 (16 pages).
International Preliminary Report on Patentabitliy issued in PCT Application PCT/US2017/036458 dated Dec. 10, 2019 (12 pages).
Office Action issued in U.S. Appl. No. 16/781,772 dated Feb. 15, 2022, 18 pages.
Office Action issued in U.S. Appl. No. 16/781,826 dated Aug. 23, 2023, 13 pages.

* cited by examiner

HYDRAULIC INDEXING SYSTEM

CROSS-REFERENCE TO RELATED APPLICATIONS

The present application is a Continuation Application of U.S. application Ser. No. 16/620,524 filed Dec. 9, 2019, which is the National Stage Entry PCT Application PCT/US2017/036458, filed Jun. 8, 2017, which is incorporated herein in their entirety for all purposes.

BACKGROUND

Downhole well systems sometimes use downhole flow control valves and other devices which are hydraulically actuated by double acting hydraulic pistons. For example, a downhole control valve may employ a double acting hydraulic piston to operate a moving sleeve which, in turn, controls the inflow or outflow of fluid with respect to the surrounding borehole and formation. Actuating fluid is supplied from a surface pressure source and routed downhole through two hydraulic control lines coupled with hydraulic control chambers on opposed sides of the actuating piston. One hydraulic line provides high-pressure fluid to a hydraulic control chamber on one side of the piston while the other hydraulic line evacuates an equivalent volume of low-pressure exhaust fluid from the hydraulic control chamber on the other side of the piston. Sometimes a mechanical indexer may be combined with the flow control valve to enable indexing of the piston to several operational positions.

SUMMARY

In general, a system and methodology enable a desired control over incremental actuation of hydraulic devices. A hydraulically actuated tool is combined with a control module. The hydraulically actuated tool has an actuator piston positioned in a piston chamber and movable between operating positions. The control module comprises a hydraulic indexing circuit arranged to enable incremental movement of the actuator piston in a first direction and full stroke movement in a second direction based on hydraulic input delivered via control lines. The hydraulic indexing circuit comprises an indexing piston system and at least one check valve working in cooperation with the indexing piston system to enable the incremental and full stroke movements.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
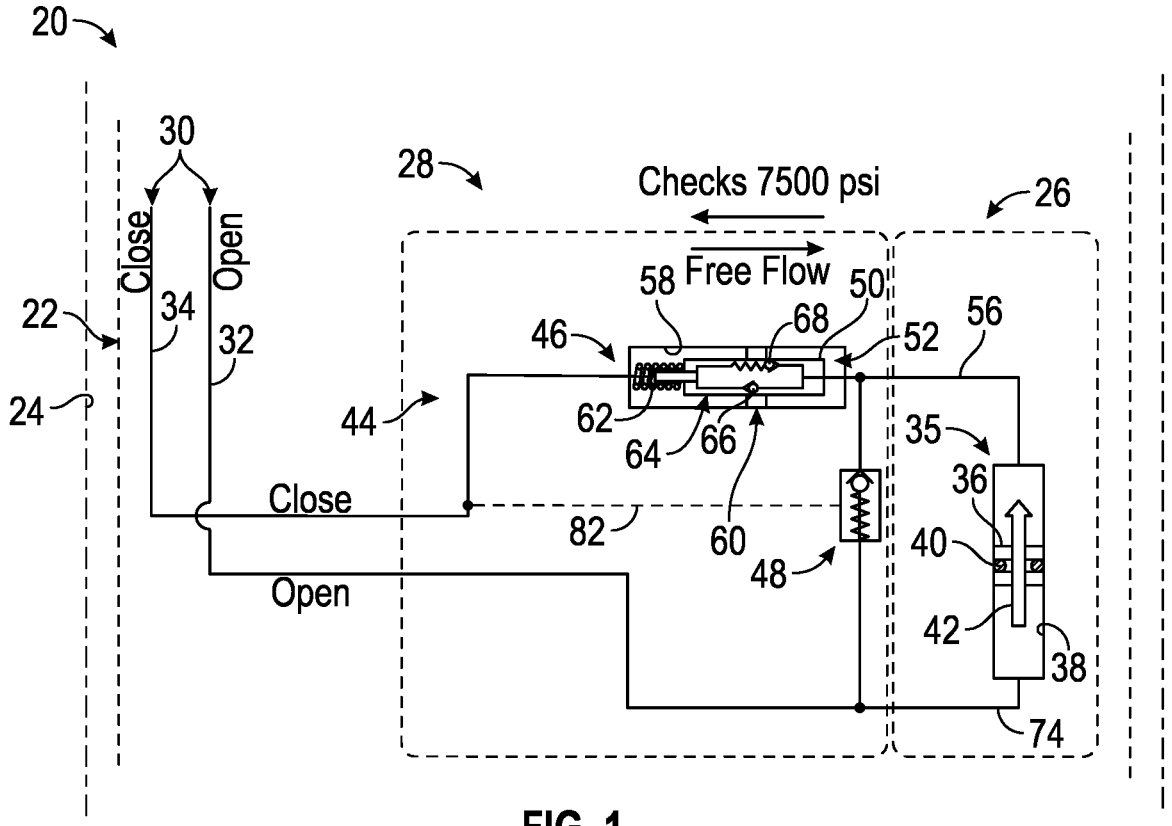
FIG. 1 is a schematic illustration of a well system deployed in a wellbore, the well system comprising an embodiment of a hydraulically actuated device and a hydraulic control module, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate a desired control over incremental actuation of hydraulic devices. A hydraulically actuated tool, e.g. a flow control valve, is combined with a control module. The hydraulically actuated tool has an actuator piston positioned in a piston chamber and movable between operating positions. For example, the actuator piston may be indexed or incrementally moved to a plurality of operating positions such as a closed position, fully open position, and one or more positions therebetween.

According to an embodiment, the control module comprises a hydraulic indexing circuit arranged to enable incremental movement of the actuator piston in a first direction. The hydraulic indexing circuit also enables full stroke movement in a second direction based on hydraulic input delivered via control lines. If, for example, the hydraulically actuated device is a flow control valve, and actuator piston of the flow control valve may be incrementally actuated toward a fully open flow position or fully stroked to the closed position depending on the hydraulic input delivered via the control lines. The hydraulic indexing circuit comprises an indexing piston system and at least one check valve working in cooperation with the indexing piston system to enable the incremental and full stroke movements.

The control module may perform as a metering module enabled by appropriate hydraulic components and features of the hydraulic indexing circuit. When combined with a hydraulically actuated device, e.g. a hydraulically actuated downhole tool, the control module provides controlled movement of an actuator piston in a desired direction, e.g. an open or close direction, as well as a quick, full stroke piston movement in the opposite direction. The hydraulic indexing circuit also may be constructed to provide an override to enable a full stroke piston movement in both directions.

By way of specific example, the hydraulic indexing circuit enables controlled movement of an actuator piston incrementally in a desired direction, e.g. an opening direction, by metering a predetermined amount of hydraulic fluid at each pressure cycle. The hydraulic indexing circuit also enables a full stroke movement of the actuator piston in the opposite direction, e.g. a closing direction, when the associated hydraulic control line is sufficiently pressurized. In some embodiments, the hydraulic indexing circuit also may provide a hydraulic override to enable a full stroke movement of the actuator piston in the first direction, e.g. the opening direction, when pressure is applied in the appropriate hydraulic control line above a threshold pressure, e.g. a predetermined, metering break-out pressure. The overall system may utilize hydraulic control modules, described herein, to replace traditional mechanical indexing mechanisms, thus providing a simpler and more cost effective system.

Referring generally to FIG. 1, an embodiment of a well system 20 is illustrated. In this example, well system 20 has a well string 22 deployed in a wellbore 24, e.g. a horizontal or otherwise deviated wellbore. The well string 22 comprises a hydraulically actuated device 26 and a control module 28 used to control the hydraulic actuation of device 26. By way of example, the control module 28 receives hydraulic actuating fluid via a pair of hydraulic control lines 30, e.g. an open line 32 and a close line 34. The hydraulic control lines 30 are routed to control module 28 from an actuating fluid pressure source, such as a surface located source.

According to the illustrated embodiment, the hydraulically actuated device 26 comprises an actuator 35 having an actuator piston 36 slidably positioned in a piston chamber 38. The actuator piston 36 may be sealed with respect to an annular surface of piston chamber 38 via a suitable seal 40, e.g. an O-ring seal. The actuator piston 36 may be moved incrementally in a first direction, represented by arrow 42, and may be moved in a full stroke in a second or opposite direction. In some applications, the first direction 42 may be an opening direction and the second direction may be a closing direction. For example, if hydraulically actuated device 26 is in the form of a valve the first direction indicated by arrow 42 may be a valve opening direction and the opposite direction may be a valve closing direction.

In the illustrated embodiment, the control module 28 is operatively coupled with hydraulically actuated device 26 and comprises a hydraulic indexing circuit 44. The hydraulic indexing circuit 44 may comprise various flow channels and components arranged to enable incremental movement of the actuator piston 36 in the first direction 42 and a full stroke movement of the actuator piston 36 in the second or opposite direction. According to the illustrated example, the incremental movement in one direction and the full stroke movement in the opposite direction is achieved based solely on hydraulic input delivered via hydraulic control lines 30.

To achieve the desired motion of actuator piston 36, the hydraulic indexing circuit 44 may comprise an indexing piston system 46 working in cooperation with at least one check valve 48. In this example, the indexing piston system 46 comprises an indexing piston 50 positioned in the hydraulic indexing circuit 44 to provide the incremental movement of actuator piston 36 based on limiting an outflow of fluid from the piston chamber 38 for each pressure up and pressure down cycle.

Figure 2:
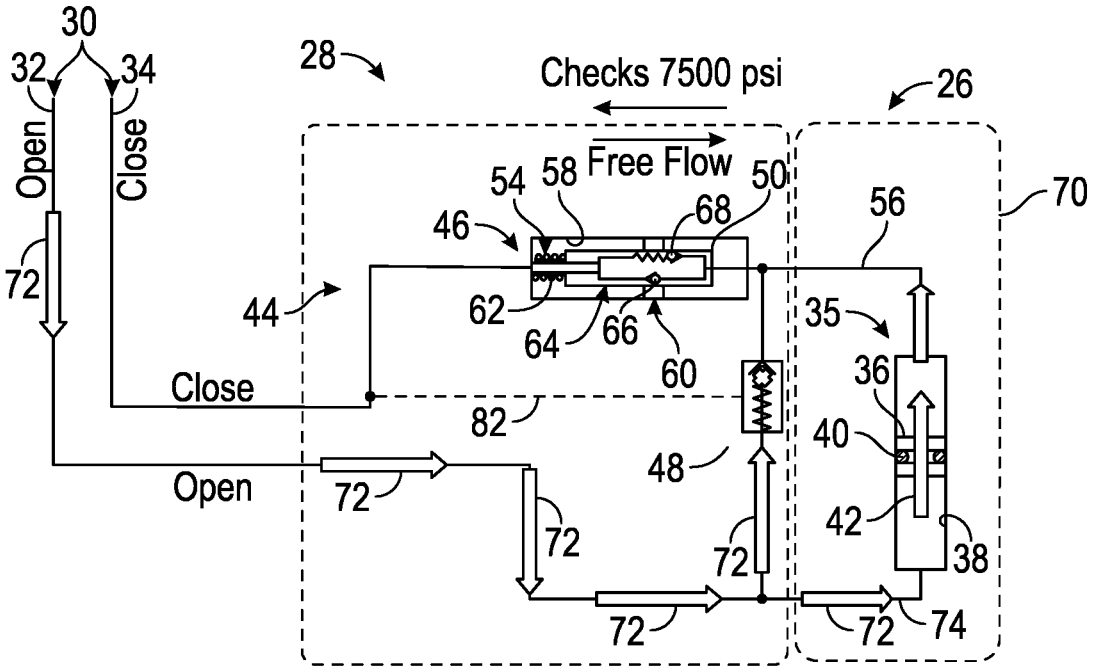
FIG. 2 is a schematic illustration of an example of a control module coupled with a hydraulic actuator of a hydraulically actuated device, according to an embodiment of the disclosure.

The outflow of fluid from the piston chamber 38 is limited to a predetermined amount of fluid established via movement of the indexing piston 50 from a default position 52 (see FIG. 1) to a stop position 54 (see FIG. 2). The piston 50 is moved by actuating fluid flowing out of the corresponding side of piston chamber 38, through a flow line segment 56, and into indexing piston system 46. When movement of indexing piston 50 is stopped at the stop position 54, no additional fluid can flow through flow line segment 56 and into indexing piston system 46. Consequently, further movement of actuator piston 36 is stopped and no additional actuating fluid can enter the piston chamber 38 on an opposite side of actuator piston 36.

In the illustrated embodiment of indexing piston system 46, the indexing piston 50 is slidably mounted within a corresponding indexing piston chamber 58 and is placed in sealing engagement with the surrounding surface forming indexing piston chamber 58. The sealing engagement may be formed via a sealing system 60, e.g. an O-ring seal or other suitable seals. The indexing piston 50 is biased toward the default position via a spring 62, e.g. a coil spring or other suitable spring.

The indexing piston system 46 also may comprise a directional relief valve 64 to control flow of actuating fluid through, for example, indexing piston 50. The directional relief valve 64 may have various configurations and may comprise suitable check valves, such as check valves 66, 68. In this example, the at least one check valve 48 comprises a normally open pilot operated check valve. However, the at least one check valve 48 may comprise other types of check valves or combinations of valves—examples of which are described in greater detail below.

In an operational example, the hydraulically actuated device 26 is in the form of a flow control valve 70 as illustrated in FIG. 2. During normal operation, the control module 28 provides metering in one direction and thus incremental movement of actuator piston 36 in that direction while allowing a quick, full stroke close in the opposite direction. In this example, the directional relief valve 64 also enables use of an override pressure to fully stroke actuator piston 36 in the first direction 42 if pressure is applied above a threshold pressure, e.g. above a relief valve cracking pressure. The relief valve cracking pressure is selected such that the cracking pressure is higher than the normal system operating pressure. Thus, the directional relief valve 64 remains closed in this direction unless pressure above the threshold cracking pressure is applied. By way of example, the threshold cracking pressure may be 7000-8000 psi, e.g. 7500 psi, but a variety of other pressure levels may be selected according to the parameters of a given operation.

To incrementally move actuator piston 36 in, for example, an opening direction, the close control line 34 is bled and the open control line 32 is pressurized to an actuating pressure level which remains below the threshold cracking pressure. By way of example, the actuating pressure level may be 5000 psi and the threshold cracking pressure may be 7500 psi although various other pressure levels may be utilized in a given operation. The delivery of actuating fluid at a desired actuating pressure in open control line 32 is represented by arrows 72 in FIG. 2.

This pressurized fluid causes the normally open pilot operated check valve 48 to close and the actuator piston 36 to move in the opening direction 42 as the pressurized hydraulic fluid enters piston chamber 38 via a flow line segment 74. As the actuator piston 36 moves, fluid on the opposite side of the piston 36 is forced out of piston chamber 38 through flow line segment 56 and into indexing piston system 46. The indexing piston 50 is moved against the biasing force of spring 62 via the fluid flowing into indexing piston system 46 under pressure, thus compressing the spring 62 until bottoming out as indexing piston 50 comes to a stop at stop position 54. Because the pressure applied is less than the threshold cracking pressure, relief valve 64 remains closed to flow therethrough.

At this stage, no additional actuating fluid is able to flow into indexing piston system 46 and movement of actuator piston 36 is stopped. Thus, the size and movement of indexing piston 50 provides a metering rate and controls the incremental movement of actuator piston 36.

Figure 3:
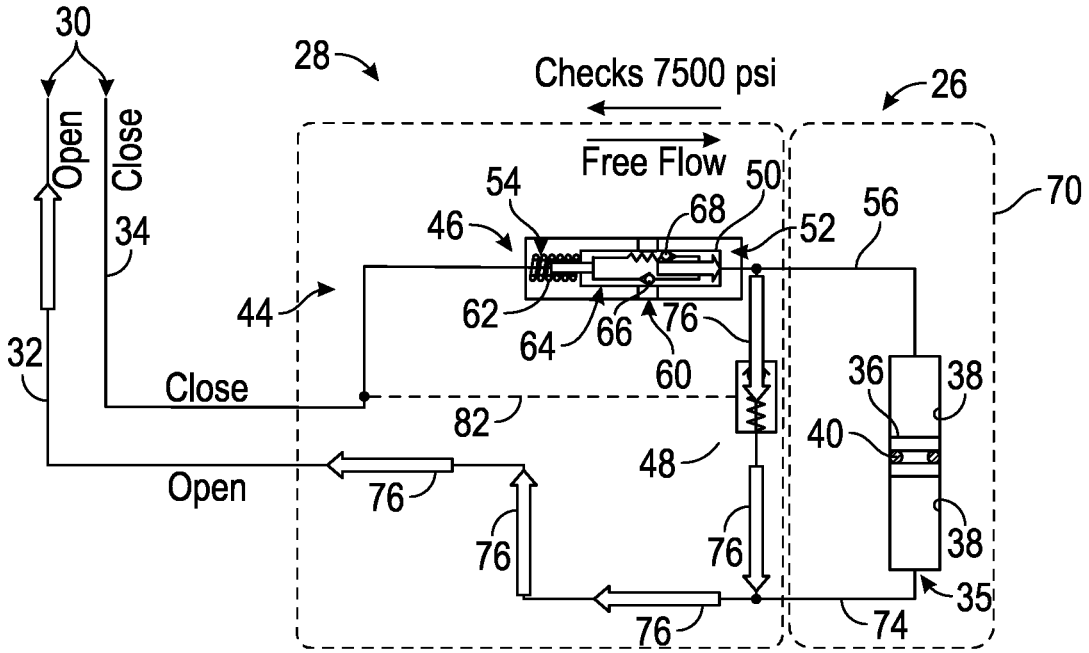
FIG. 3 is a schematic illustration similar to that of FIG. 2 but showing the control module in a different operational configuration, according to an embodiment of the disclosure.

To transition actuator piston 36 to the next incremental position, the open control line 32 is bled to allow spring 62 to push indexing piston 50 back to its default position 52. The hydraulic fluid displaced by the returning movement of indexing piston 50 is dispensed through the normally open pilot operated check valve 48 and through the open control line 32, as indicated by arrows 76 in FIG. 3. At this stage, actuating pressure may again be applied through open control line 32 to once again shift actuator piston 36 another increment, as described above with reference to FIG. 2. This cycling of increased and decreased pressure in the open control line 32 may be repeated to move the actuator piston 36 to each subsequent incremental position until the desired operating position is reached.

Figure 4:
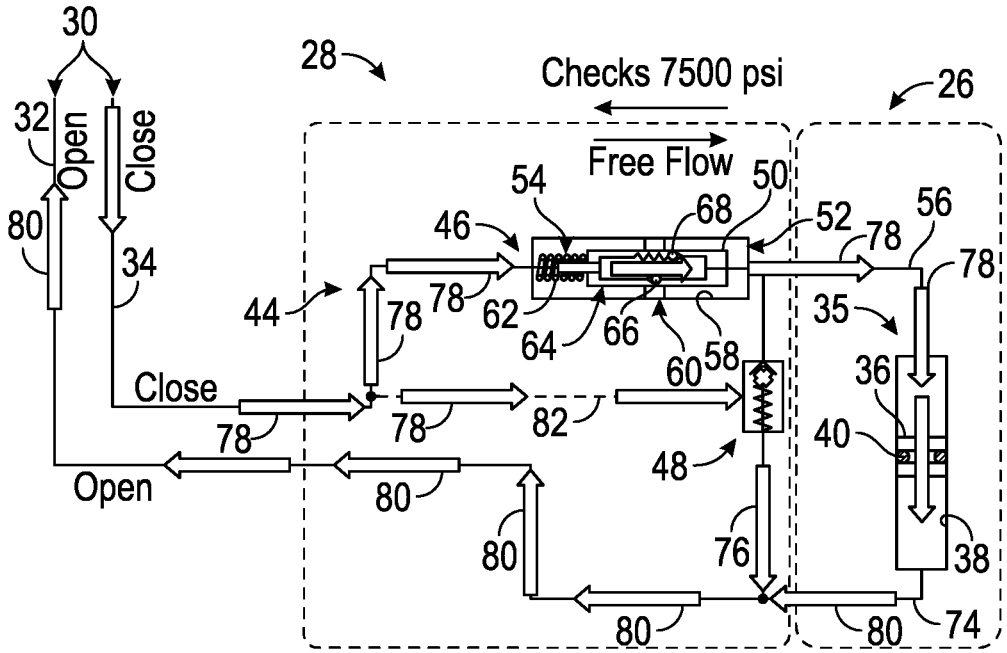
FIG. 4 is a schematic illustration similar to that of FIG. 3 but showing the control module in a different operational configuration, according to an embodiment of the disclosure.

A full stroking of the actuator piston 36 in the opposite direction, e.g. the closing direction, may be achieved by bleeding the open control line 32 and applying a sufficient pressure to the actuating fluid in close control line 34, as illustrated in FIG. 4. In FIG. 4, arrows 78 represent the application of pressurized actuating fluid through close control line 34 and arrows 80 represent the actuating fluid bled through open control line 32. In this example, a flow line segment 82 connecting close control line 34 and normally open pilot operated check valve 48 serves to pilot check valve 48 to a closed position when pressure is applied via close control line 34.

The pressurized hydraulic fluid in close control line 34 flows into indexing piston system 46 and is allowed to freely flow through the relief valve 64 via check valve 66. As a result, continued application of the pressurized hydraulic fluid through close control line 34 enables continual movement of the actuator piston 36 through a full stroke, e.g. a full stroke to the closed position. Once the actuator piston 36 is fully stroked to the desired position, the close control line 34 may be bled by reducing the pressure.

It should be noted the relief valve 64 enables a contingency measure in the form of a full stroke movement of the actuator piston in the first direction 42, e.g. an opening direction, rather than incremental movement. This "override" capability allows the hydraulically actuated device 26 to be fully shifted, e.g. fully opened, in one pressure cycle. If a plurality of the hydraulically actuated devices 26 is employed in a given system, the override capability enables the plurality of devices 26 to be fully shifted simultaneously in the first direction 42.

To achieve this contingency operation, the pressure applied to the open control line 32 is above the threshold cracking pressure, e.g. above 7500 psi, and the hydraulic actuating fluid in close control line 34 is bled. Under these conditions, the normally open pilot operated check valve 48 is once again closed and movement of the actuator piston 36 is initiated. As the actuator piston 36 continues to move in direction 42, the indexing piston 50 is shifted from the default position 52 to the stop position 54. Once the indexing piston 50 is bottomed out at the stop position 54, pressure builds up until directional relief valve 64 cracks open to allow fluid flow therethrough. By way of example, the check valve 68 of relief valve 64 may be spring biased to open when the pressure applied is above the threshold cracking pressure, e.g. above 7500 psi.

Once the actuating fluid is allowed to flow through the relief valve 64, the actuator piston 36 may be continually moved through the full stroke of movement in direction 42, e.g. an opening direction. Subsequently, the open control line 32 may be bled so that spring 62 is able to push indexing piston 50 back to the default position 52. Actuating fluid displaced by this return movement of indexing piston 50 is dispersed through the normally open pilot operated check valve 48 and into the open control line 32.

Figure 5:
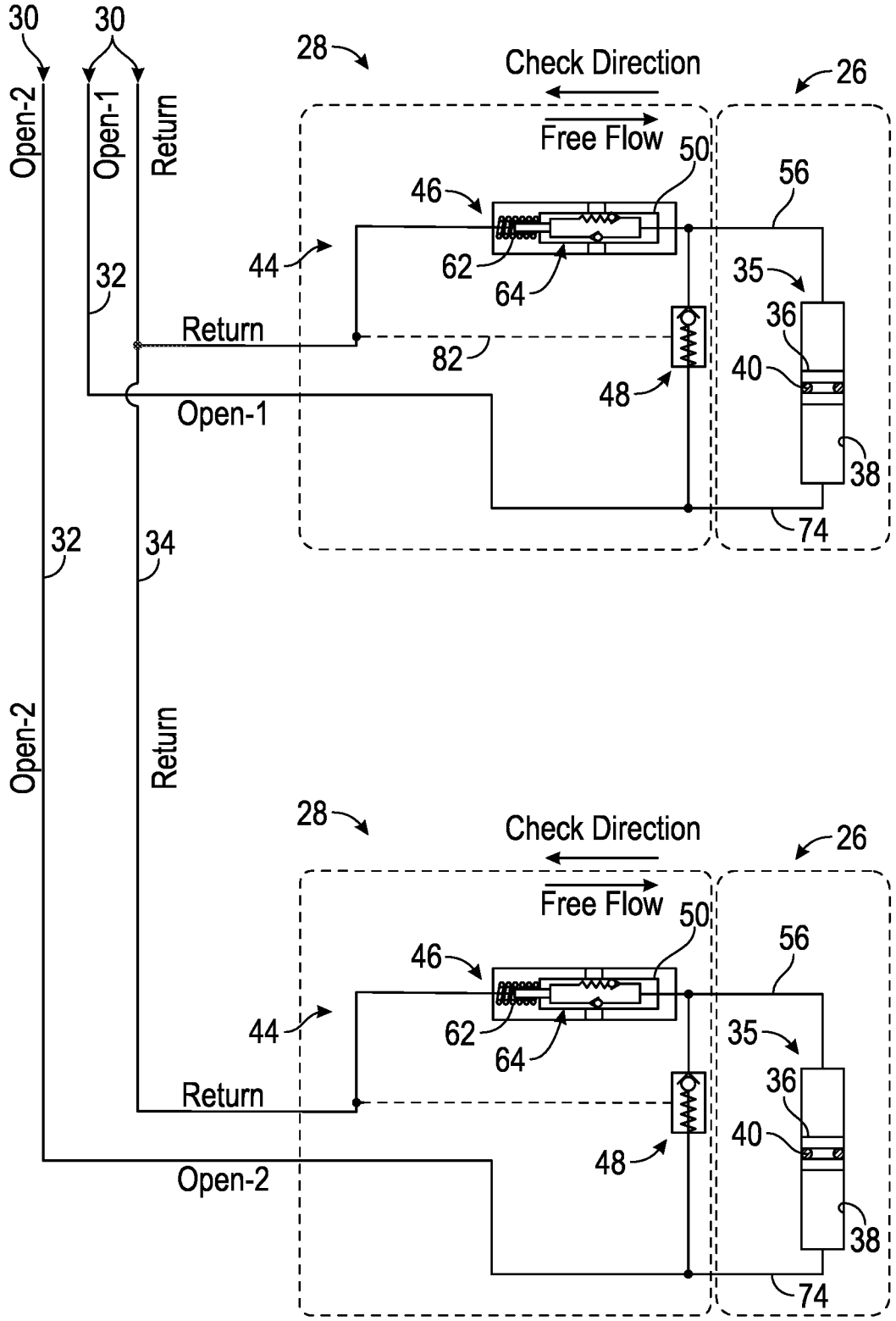
FIG. 5 is a schematic illustration of another example of a system utilizing a plurality of control modules coupled with a plurality of hydraulically actuated devices, according to an embodiment of the disclosure.

As illustrated in FIG. 5, the control module 28 may be employed in systems, e.g. downhole systems, employing multi-dropping. In other words, multiple hydraulically actuated devices 26, e.g. multiple downhole tools, can be deployed on N+1 control lines, e.g. separate opening control lines 32 and a common close or return line 34. FIG. 5 illustrates such a system in which a plurality of hydraulically actuated devices 26, e.g. a plurality of flow control valves 70, are deployed. Each device 26/valve 70 is associated with a corresponding control module 28.

Figure 6:
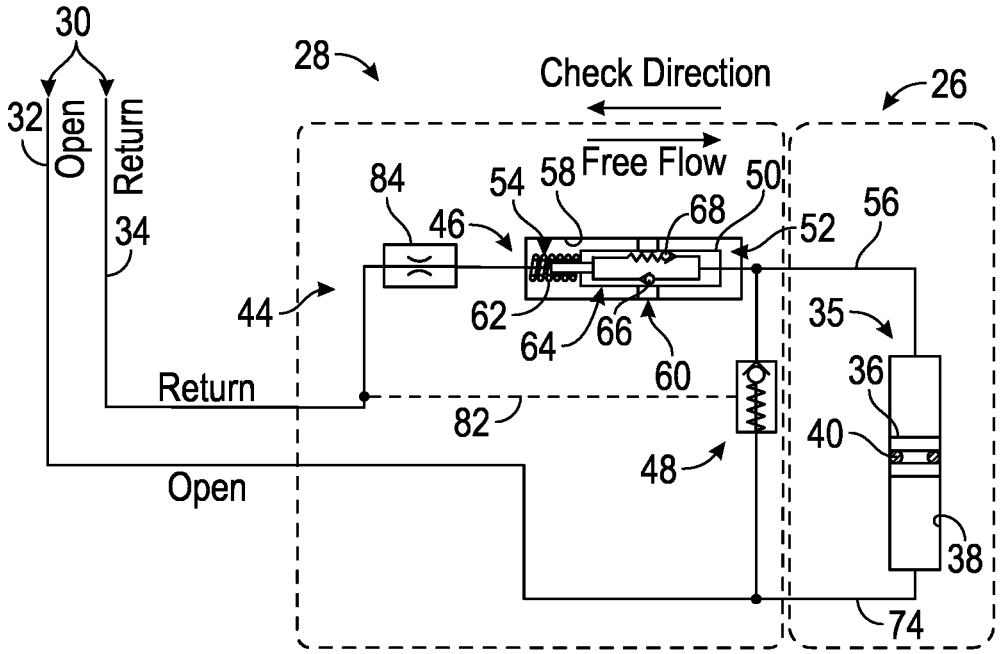
FIG. 6 is a schematic illustration of another example of a control module coupled with a hydraulic actuator of a hydraulically actuated device, according to an embodiment of the disclosure.

In a multi-drop configuration, the actuator pistons 36 of the corresponding hydraulically actuated devices 26 may be simultaneously moved to a fully stroked position, e.g. closed position, by applying the pressurized actuating fluid through the close/return control line 34. To prevent hydraulic cross talk in some applications, a flow restrictor 84 (or flow restrictors 84) may be combined into the hydraulic indexing circuit 44 on the close/return control line side of one or more of the control modules 28, as illustrated in FIG. 6.

Figure 7:
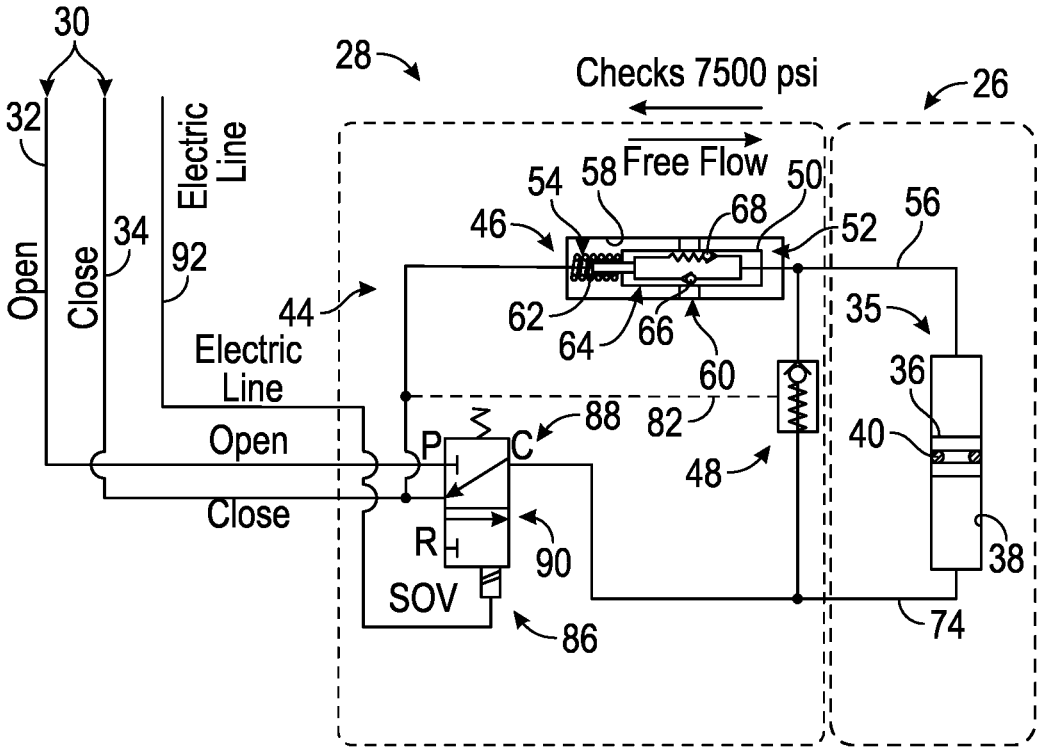
FIG. 7 is a schematic illustration of another example of a control module coupled with a hydraulic actuator of a hydraulically actuated device, according to an embodiment of the disclosure.

Referring generally to FIG. 7, another embodiment of control module 28 is illustrated. In this embodiment, control module 28 functions as an electro-hydraulic control module by combining the hydraulic indexing circuit 44 with a solenoid operated valve 86. Operation and control of the hydraulically actuated device 26 is similar to that of the embodiments described above. However, the solenoid operated valve 86 restricts actuation of actuator piston 36 and device 26 unless the solenoid operated valve 86 is energized.

As illustrated, the solenoid operated valve 86 is biased to a first flow configuration 88 which does not allow incremental actuation of actuator piston 36. The solenoid operated valve 86 also has a second flow configuration 90 which does allow actuation of the actuator piston 36 as described above with reference to FIGS. 1-4. The solenoid operated valve 86 may be energized by application of an electrical input, e.g. sufficient electrical power, via an electric line 92. When this occurs, the solenoid operated valve 86 is shifted from the first flow configuration 88 to the second flow configuration 90 so as to enable hydraulic actuation of the corresponding device 26 as described above. Effectively, shifting of the solenoid operated valve 86 to the second flow configuration 90 enables use of the open control line 32 and the close control line 34 to incrementally shift or fully stroke the actuator piston 36. The solenoid operated valve 86 is maintained in the energized state and in the second flow configuration 90 during actuation of the device 26.

Figure 8:
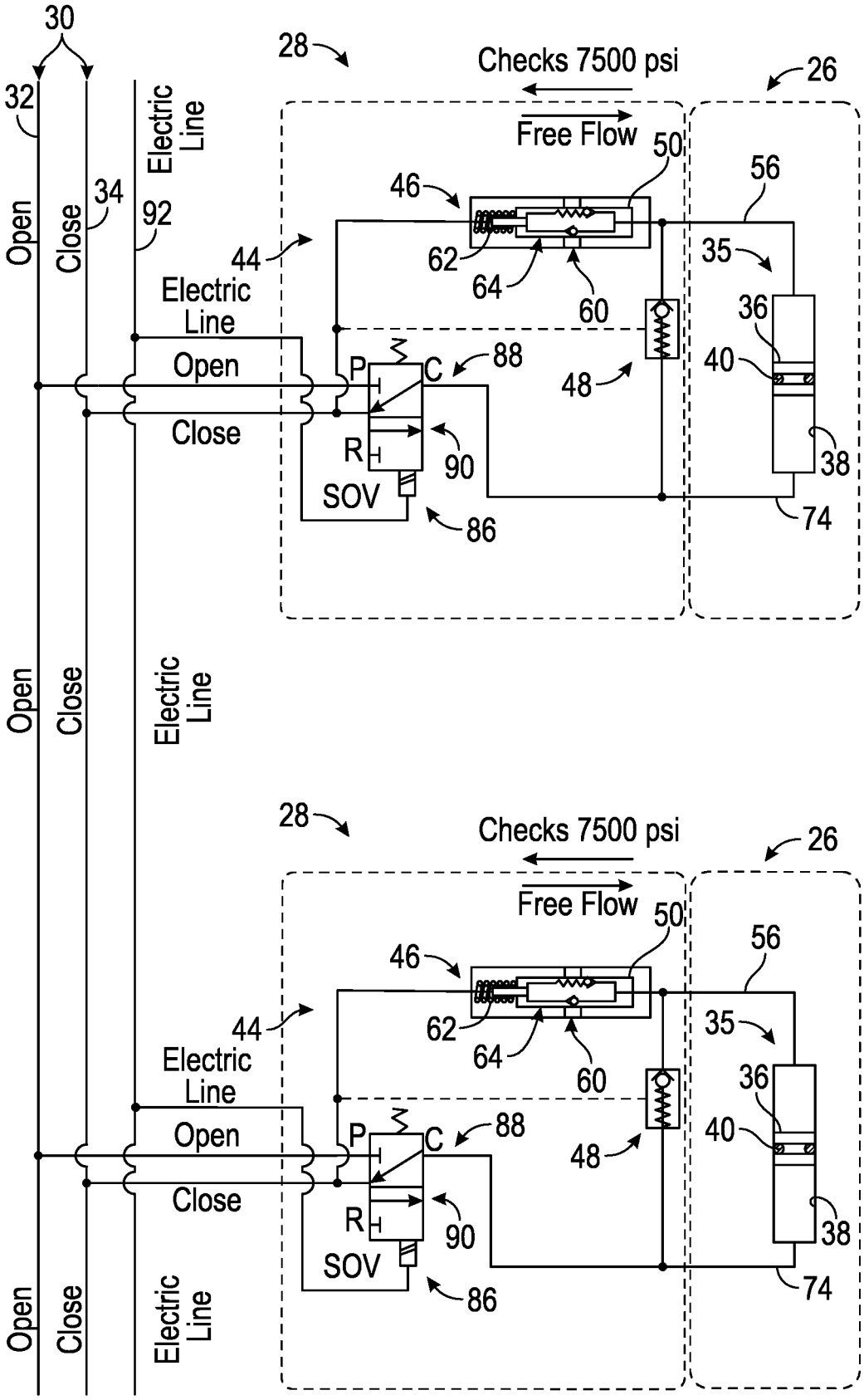
FIG. 8 is a schematic illustration similar to that of FIG. 7 but showing a plurality of control modules coupled with a plurality of hydraulically actuated devices, according to an embodiment of the disclosure.

This type of control module 28 also may be used in multi-dropping applications, as illustrated in FIG. 8. The use of solenoid actuated valves 86 in each control module 28 enables the use of a single open control line 32 and a single close control line 34. The solenoid actuated valves 86 corresponding with specific hydraulically actuated devices 26 can be selectively energized to enable the desired actuation of the specific device or devices 26. It should be noted that flow restrictors 84 may again be combined into the hydraulic indexing circuit or circuits 44 to provide pressure damping so as to reduce hydraulic cross talk between control modules 28.

Figure 9:
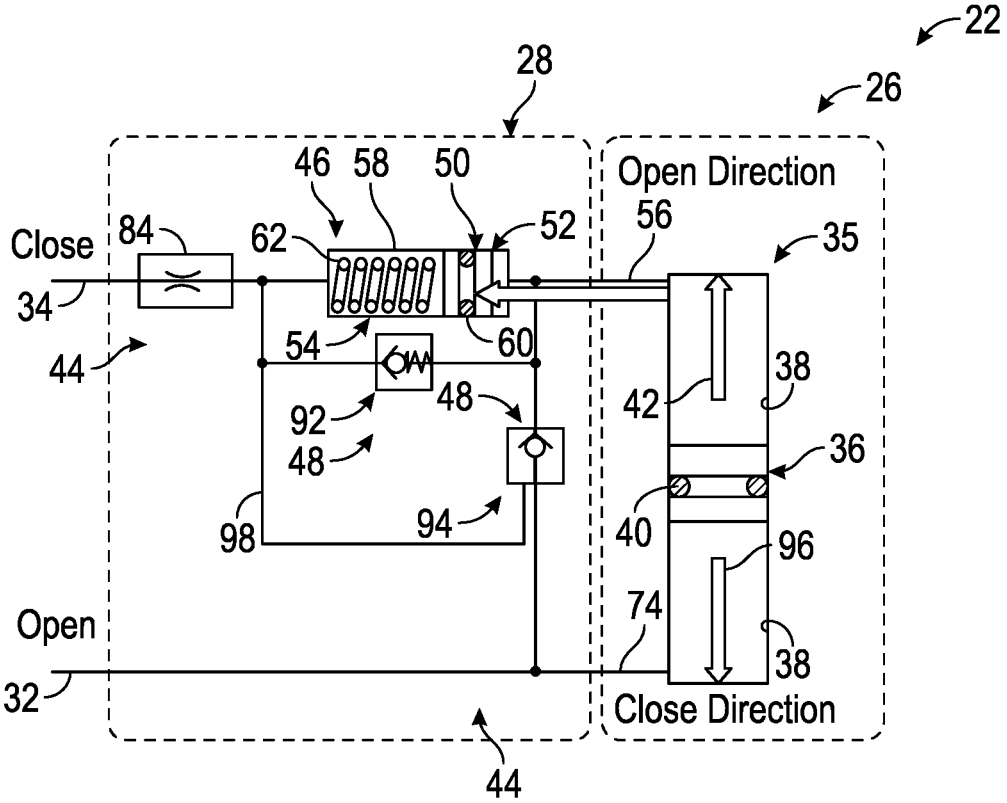
FIG. 9 is a schematic illustration of another example of a control module coupled with a hydraulic actuator of a hydraulically actuated device, according to an embodiment of the disclosure.

Referring generally to FIG. 9, another embodiment of control module 28 is illustrated. In this embodiment, many of the components and features are similar to or the same as components and features in the embodiments illustrated in FIGS. 1-8 and have been labeled with the same reference numerals. In this embodiment, however, the at least one check valve 48 comprises a bypass check valve 92 and a reset check valve 94.

In operation, the actuator piston 36 may be incrementally moved in first direction 42, e.g. an open direction, by pressurizing hydraulic line 32, e.g. open hydraulic line. The hydraulic control module 28 allows the pressurized hydraulic actuating fluid to reach piston chamber 38 and to apply force against the actuator piston 36 to move the actuator piston 36 in the first direction 42. During this movement, the pressure in hydraulic line 32 maintains reset check valve 94 in a closed position as the indexing piston 50 is stroked from the default position 52 to the stop position 54. As described above, the stroke of indexing piston 50 allows enough actuating fluid to displace from piston chamber 38 via flow line 56 to allow a desired incremental movement of actuator piston 36.

Following the incremental movement of actuator piston 36, the pressure on hydraulic line 32 is released and this allows the indexing piston 50 to reset to its initial, default position via the force applied by indexing piston return spring 62. The actuating fluid displaced by the return movement of indexing piston 50 is directed through reset check valve 94 and back to the hydraulic line 32. At this stage, the control module 28 and the actuated device 26 are ready for another incremental actuation. This process of pressure cycling can be repeated until the actuator piston 36 and actuated device 26 are in the desired position.

As with previously described embodiments, the actuator piston 36 may be fully stroked in an opposite direction, e.g. a closing direction, represented by arrow 96. The pressure of hydraulic actuating fluid is increased in the hydraulic line 34, e.g. hydraulic close line, and the reset check valve 94 is shifted to a closed position via pressure applied via flow line 98. Simultaneously, the bypass check valve 92 allows the actuating fluid to bypass the indexing piston 50 and flow piston chamber 38 on a "closing" side of actuator piston 36 via flow line 56.

The actuating fluid may continuously be delivered through bypass check valve 92 and into piston chamber 38 to move actuator piston 36 in the direction of arrow 96 until the actuator piston 36 is fully stroked. The fluid on the opposite side of actuator piston 36 is exhausted through the hydraulic line 32. After the actuator piston 36 has been fully moved in the direction of arrow 96, the pressure in hydraulic line 34 may be bled off.

In this embodiment, the actuator piston 36 and hydraulically actuated tool 26 also may be manually operated without reliance on hydraulic pressure delivered via hydraulic lines 32, 34. The control module 28 is constructed to allow movement of actuator piston 36 without hydraulic lock. When the actuator piston 36 is manually shifted in the direction of arrow 42, fluid from the upper illustrated side of chamber 38 is exhausted through flow line 56, through reset check valve 94, and to the hydraulic line 32. During movement of the actuator piston 36, the exhausted fluid may enter piston chamber 38 on an opposite side of actuator piston 36 via flow line 74.

When the actuator piston 36 is manually shifted in the opposite direction (the direction of arrow 96), fluid from the lower illustrated side of chamber 38 is exhausted through flow line 74 to hydraulic line 32. To avoid hydraulic lock, the piston chamber 38 on the opposite side of actuator piston 36 is supplied with fluid from the hydraulic line 34. Fluid in hydraulic line 34 flows through bypass check valve 92 and into the piston chamber 38 via flow line 56. Thus, the hydraulic control module 28 allows the actuator piston 36 and corresponding actuated tool 26 to be shifted even if the supply of hydraulic actuating fluid is blocked.

Figure 10:
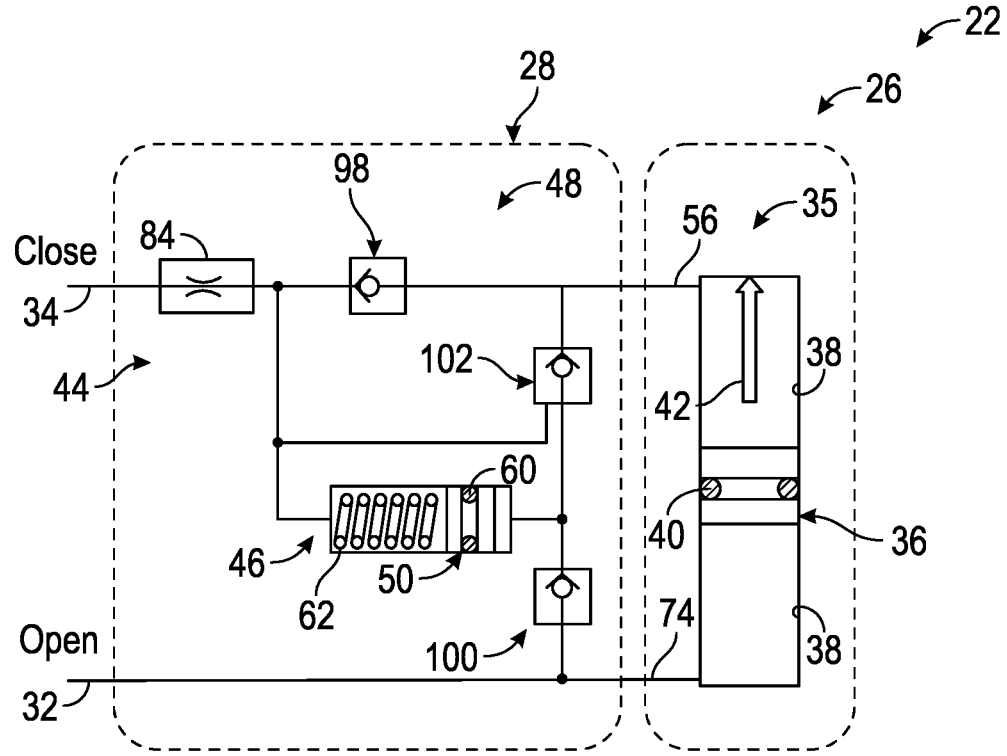
FIG. 10 is a schematic illustration of another example of a control module coupled with a hydraulic actuator of a hydraulically actuated device, according to an embodiment of the disclosure.

Referring generally to FIG. 10, another embodiment of control module 28 is illustrated. In this embodiment, the at least one check valve 48 comprises a bypass check valve 98, a reset check valve 100, and a piloted check valve 102. In operation, the actuator piston 36 may be incrementally moved in first direction 42, e.g. an open direction, by pressurizing hydraulic line 32, e.g. open hydraulic line. The hydraulic control module 28 allows the pressurized hydraulic actuating fluid to reach piston chamber 38 and to apply force against the actuator piston 36 to move the actuator piston 36 in the first direction 42.

During this movement, the bypass check valve 98 and the reset check valve 100 remain closed as actuating fluid flows through piloted check valve 102 and into indexing piston system 46 until the indexing piston 50 is stroked from the default position 52 to the stop position 54. The stroke of indexing piston 50 allows enough actuating fluid to displace from piston chamber 38 via flow line 56 to allow a desired incremental movement of actuator piston 36.

Following the incremental movement of actuator piston 36, the pressure on hydraulic line 32 is released and this allows the indexing piston 50 to reset to its initial, default position via the force applied by indexing piston return spring 62. The actuating fluid displaced by the return movement of indexing piston 50 is directed through reset check valve 100 and back to the hydraulic line 32. At this stage, the control module 28 and the actuated device 26 are ready for another incremental actuation. This process can be repeated until the actuator piston 36 and actuated device 26 are in the desired position.

Again, the actuator piston 36 may be fully stroked in an opposite direction, e.g. a closing direction (see arrow 96 in FIG. 9). For example, the pressure of hydraulic actuating fluid may be increased in the hydraulic line 34, e.g. hydraulic close line, so the hydraulic actuating fluid flows through bypass check valve 98, through flow line 56, and into piston chamber 38. The piloted check valve 102 remains piloted to the closed position, and the hydraulic fluid flowing into piston chamber 38 is able to move actuator piston 36 through a full stroke to, for example, the closed position. The actuating fluid on an opposite side of actuator piston 36 is exhausted through the hydraulic line 32 as the reset check valve 100 remains closed.

In this embodiment, the actuator piston 36 and hydraulically actuated tool 26 also may be manually operated without reliance on hydraulic pressure delivered via hydraulic lines 32, 34. The control module 28 is constructed to allow movement of actuator piston 36 without hydraulic lock. When the actuator piston 36 is manually shifted in the first direction 42, fluid from the upper illustrated side of chamber 38 is exhausted through flow line 56, through piloted check valve 102, through reset check valve 100, and back into piston chamber 38 on an opposite side of actuator piston 36 via flow line 74.

When the actuator piston 36 is manually shifted in the opposite direction, e.g. the closing direction, fluid from the lower illustrated side of chamber 38 is exhausted through flow line 74 to hydraulic line 32. To avoid hydraulic lock, the piston chamber 38 on the opposite side of actuator piston 36 is supplied with fluid from the hydraulic line 34. Fluid in hydraulic line 34 flows through bypass check valve 98 and into the piston chamber 38 via flow line 56. Thus, the hydraulic control module 28 again allows the actuator piston 36 and corresponding actuated tool 26 to be shifted even if the supply of hydraulic actuating fluid is blocked.

Figure 11:
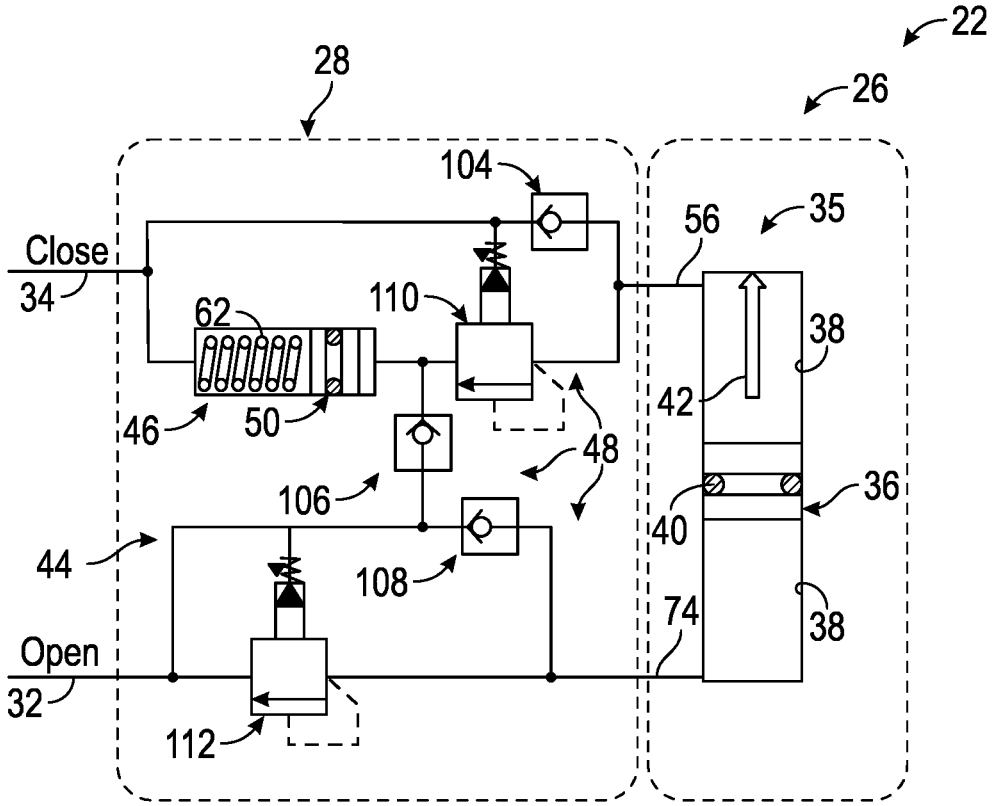
FIG. 11 is a schematic illustration of another example of a control module coupled with a hydraulic actuator of a hydraulically actuated device, according to an embodiment of the disclosure.

Referring generally to FIG. 11, another embodiment of control module 28 is illustrated. In this embodiment, the at least one check valve 48 comprises a bypass check valve 104, a reset check valve 106, and a close check valve 108. However, the hydraulic indexing circuit 44 also comprises an open sequence valve 110 and a close sequence valve 112 which work in cooperation with check valves 104, 106, 108. In operation, the actuator piston 36 may be incrementally moved in first direction 42, e.g. an open direction, by pressurizing hydraulic line 32, e.g. open hydraulic line. The hydraulic control module 28 allows the pressurized hydraulic actuating fluid to reach piston chamber 38 and to apply force against the actuator piston 36 to move the actuator piston 36 in the first direction 42. To enable the incremental movement of actuator piston 36, the reset check valve 106 and the close sequence valve 112 remain closed as actuating fluid flows through close check valve 108, through flow line 74 and into chamber 38.

During this movement of actuator piston 36, the fluid exhausted from chamber 38 maintains bypass check valve 104 in a closed position and flows through the open sequence valve 110 to indexing piston system 46. The open sequence valve 110 opens via the pressure of the exhausted actuator fluid (which pressure increases as actuator piston 36 is incrementally shifted). The exhausted actuating fluid flows into indexing piston system 46 until the indexing piston 50 is stroked from the default position 52 to the stop position 54. The stroke of indexing piston 50 allows enough actuating fluid to displace from piston chamber 38 via flow line 56 to allow a desired incremental movement of actuator piston 36.

Following the incremental movement of actuator piston 36, the pressure on hydraulic line 32 is released and this allows the indexing piston 50 to reset to its initial, default position via the force applied by indexing piston return spring 62. The actuating fluid displaced by the return movement of indexing piston 50 is directed through reset check valve 106 and back to the hydraulic line 32. At this stage, the control module 28 and the actuated device 26 are ready for another incremental actuation. This process can be repeated until the actuator piston 36 and actuated device 26 are in the desired position.

Again, the actuator piston 36 may be fully stroked in an opposite direction, e.g. a closing direction (see arrow 96 in FIG. 9). For example, the pressure of hydraulic actuating fluid may be increased in the hydraulic line 34, e.g. hydraulic close line, so the hydraulic actuating fluid flows through bypass check valve 104, through flow line 56, and into piston chamber 38. The actuating fluid on an opposite side of actuator piston 36 is exhausted through flow line 74 and out through hydraulic line 32 and close sequence valve 112. The close sequence valve 112 is opened to accommodate this exhaust flow once the pressure of the exhausted actuating fluid sufficiently rises due to the "closing" movement of actuator piston 36. The pressure of the exhaust fluid also maintains closed check valve 108 in a closed position.

In this embodiment, the actuator piston 36 and hydraulically actuated tool 26 also may be manually operated without reliance on hydraulic pressure delivered via hydraulic lines 32, 34. The control module 28 is constructed to allow movement of actuator piston 36 without hydraulic lock. When the actuator piston 36 is manually shifted in the first direction, fluid from the upper illustrated side of chamber 38 is exhausted through the open sequence valve 110, through the reset check valve 106, through the close check valve 108, and back into chamber 38 on an opposite side of actuator piston 36 via flow line 74.

When the actuator piston 36 is manually shifted in the opposite direction, e.g. the closing direction, fluid from the lower illustrated side of chamber 38 is exhausted through flow line 74 to hydraulic line 32 through close sequence valve 112. To avoid hydraulic lock, the piston chamber 38 on the opposite side of actuator piston 36 is supplied with fluid from the hydraulic line 34. Fluid in hydraulic line 34 flows through bypass check valve 104 and into the piston chamber 38 via flow line 56. Thus, the hydraulic control module 28 again allows the actuator piston 36 and corresponding actuated tool 26 to be shifted even if the supply of hydraulic actuating fluid is blocked.

Depending on parameters of a given application, the control module 28 may be constructed in a variety of configurations and may comprise various features. Examples of such features include various configurations of a hydraulic circuits, check valves, indexing piston systems, sequence valves, or other features to enable the functionality described above. Similarly, the control module 28 may be used to control actuation of many types of devices 26. In a variety of well operations, e.g. production operations, the control module 28 may be used to control a corresponding flow control valve 70 used, in turn, to control fluid flow with respect to a downhole completion. For example, the flow control valve 70 may be used to control the inflow of well fluids into sand screen assemblies. Some applications utilize multiple control modules 28 with multiple corresponding flow control valves or other hydraulically controlled devices. The control module 28 also may be used in non-well related applications to similarly control various types of hydraulically actuated devices.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a well string deployed in a wellbore, the well string comprising a flow control valve and a control module for controlling flow positions of the flow control valve via positioning of an actuator piston in a piston chamber of the flow control valve, the control module comprising:

a hydraulic indexing circuit arranged to enable incremental movement of the actuator piston in a first direction and a full stroke movement in a second direction based solely on hydraulic input delivered via a pair of control lines, the hydraulic indexing circuit having:

an indexing piston system comprising an indexing piston to provide the incremental movement in the first direction based on limiting an outflow of fluid from the piston chamber via movement of the indexing piston from a default position to a stop position within an indexing piston chamber for each incremental movement of the actuator piston, wherein the indexing piston includes a directional relief valve configured to allow fluid communication through the indexing piston in the first direction in response to fluid in the indexing piston chamber exceeding a threshold pressure; and at least one check valve positioned to enable return of the indexing piston from the stop position to the default position.

2. The system as recited in claim 1, wherein the pair of control lines comprises an open line and a close line.

3. The system as recited in claim 2, wherein hydraulic input delivered via the open line in the first direction causes incremental movement of the actuator piston in the first direction via cycles of:

increased pressure; and decreased pressure, wherein the increased pressure is less than the threshold pressure.

4. The system as recited in claim 3, wherein hydraulic input delivered via the close line as continued pressure in the second direction causes the full stroke movement of the actuator piston in the second direction to a fully closed position.

5. The system as recited in claim 4, wherein hydraulic input delivered via the open line as continued pressure above the threshold pressure causes full stroke movement of the actuator piston in the first direction to a fully open position.

6. The system as recited in claim 1, wherein the well string comprises a plurality of flow control valves and a plurality of control modules.

7. The system as recited in claim 1, wherein the indexing piston system comprises a spring biasing the indexing piston to the default position.

8. The system as recited in claim 1, wherein the at least one check valve comprises a normally open pilot operated check valve.

9. The system as recited in claim 1, wherein at least one control line of the pair of control lines comprises a flow restrictor.

10. The system as recited in claim 1, wherein the hydraulic indexing circuit further comprises a solenoid operated valve electrically operated to selectively enable flow in the pair of control lines.

11. A system, comprising:

a tool having an actuator piston positioned in a piston chamber, the actuator piston being movable between operating positions; and a control module comprising a hydraulic indexing circuit arranged to enable incremental movement of the actuator piston in a first direction and a full stroke movement in a second direction based on hydraulic input delivered via control lines, the hydraulic indexing circuit having:

an indexing piston system comprising an indexing piston to provide the incremental movement in the first direction based on limiting an outflow of fluid from the piston chamber via movement of the indexing piston from a default position to a stop position in an indexing piston chamber for each incremental movement of the actuator piston, wherein the indexing piston includes a directional relief valve configured to allow fluid communication through the indexing piston in the first direction in response to fluid in the indexing piston chamber exceeding a threshold pressure; and at least one check valve positioned to enable return of the indexing piston from the stop position to the default position.

12. The system as recited in claim 11, wherein the tool comprises a plurality of tools positioned along a well string and the control module comprises a plurality of control modules positioned along the well string.

13. The system as recited in claim 12, wherein the plurality of tools comprises a plurality of flow control valves.

14. The system as recited in claim 11, wherein;

the control lines comprise an open line and a close line;

hydraulic input delivered via the open line in the first direction causes incremental movement of the actuator piston in the first direction via cycles of:

increased pressure; and decreased pressure, wherein the increased pressure is less than the threshold pressure; and hydraulic input delivered via the close line as continued pressure in the second direction causes the full stroke movement of the actuator piston in the second direction to a fully closed position.

15. The system as recited in claim 14, wherein hydraulic input delivered via the open line as continued pressure above the threshold pressure causes full stroke movement of the actuator piston in the first direction to a fully open position.

16. A method, comprising:

positioning a hydraulically actuated device in a wellbore;

changing operational positions of the hydraulically actuated device via an actuator piston;

fluidly coupling the actuator piston with a hydraulic circuit located downhole in the wellbore;

using the hydraulic circuit to meter predetermined amounts of actuating fluid via an indexing piston disposed in an indexing piston chamber to thus move the actuator piston in desired increments in a first direction via cycles of hydraulic pressure applied in a first control line, wherein the indexing piston includes a directional relief valve configured to allow fluid communication through the indexing piston in the first direction in response to fluid in the indexing piston chamber exceeding a threshold pressure; and further using the hydraulic circuit to enable full stroke movement of the actuator piston in a second direction via hydraulic pressure applied in a second control line.

17. The method as recited in claim 16, wherein positioning comprises positioning a flow control valve in the wellbore along a well string.

18. The method as recited in claim 16, further comprising utilizing the hydraulic circuit to enable full stroke movement in the first direction via hydraulic pressure applied above the threshold pressure.

* * * * *